United States Patent [19]

Taylor, Jr.

[11] 4,332,097

[45] Jun. 1, 1982

[54] DRUM MAGAZINE FOR AUTOMATIC PISTOL OR THE LIKE

[76] Inventor: William J. Taylor, Jr., 828 Sycamore Dr., Decatur, Ga. 30030

[21] Appl. No.: 80,709

[22] Filed: Oct. 1, 1979

[51] Int. Cl.[3] ..... F41C 25/10

[52] U.S. Cl. ..... 42/50; 89/33 D

[58] Field of Search ..... 42/6, 49 R, 49 A, 50; 89/33 D

[56] References Cited

U.S. PATENT DOCUMENTS

| | | | |
|---|---|---|---|
| 1,042,837 | 10/1912 | Tatarek | 89/33 D |
| 1,833,431 | 11/1931 | McCormick et al. . | |
| 2,007,774 | 7/1935 | Sedgley et al. | 42/50 |
| 2,064,888 | 12/1936 | Dickinson | 42/6 |
| 2,066,361 | 1/1937 | Nomar | 42/6 |
| 2,114,311 | 4/1938 | Nomar | 42/49 R |
| 2,130,722 | 9/1938 | Kobe | 42/19 |
| 2,131,412 | 9/1938 | Östman | 42/49 R |
| 2,311,497 | 2/1943 | Van Horn et al. | 42/50 |
| 2,338,984 | 1/1944 | Van Horn et al. | 42/50 |
| 2,394,606 | 2/1946 | Gazda | 89/33 D |
| 3,239,959 | 3/1966 | Sefried et al. | 42/19 |

FOREIGN PATENT DOCUMENTS

| | | | |
|---|---|---|---|
| 302455 | 2/1922 | Fed. Rep. of Germany | 42/50 |
| 496950 | 11/1919 | France | 42/50 |

*Primary Examiner*—Stephen C. Bentley

*Attorney, Agent, or Firm*—Jones & Askew

[57] ABSTRACT

A cartridge feeding drum magazine for use with semi-automatic or full-automatic firearms such as pistols or submachine guns. A rotor is provided within a drum housing to define an annular cartridge-receiving channel, and a magazine extension joins the drum at 90° thereto for insertion within the existing magazine receptacle of a firearm. The rotor, which is spring-biased for rotation, carries a separate magazine spring within a housing, so that the magazine spring remains enclosed while the rotor turns to feed cartridges. The magazine spring moves out of its housing to urge remaining cartridges through the magazine extension, after cartridge-feeding movement of the rotor is completed.

9 Claims, 8 Drawing Figures

DRUM MAGAZINE FOR AUTOMATIC PISTOL OR THE LIKE

BACKGROUND OF THE INVENTION

This invention relates in general to cartridge magazines for firearms, and in particular to magazines for column-feed firearms such as pistols or submachine guns.

Semiautomatic and full-automatic firearms such as pistols and submachine guns typically utilize a column feed arrangement to store a supply of cartridges for feeding to the action of the firearm. The column cartridge feed arrangement usually is embodied in a receptacle or well formed in the firearm and configured to receive a cartridge magazine, and separate magazines which typically store cartridges in a linear column. The cartridges in the magazine may occupy a single column, one above the other, as in the 0.45 Colt automatic pistol, or may alternatively occupy a double-column staggered arrangement which increases the number of cartridges storable in a magazine of given length.

Shooters generally prefer magazines that hold a greater number of cartridges. The casual shooter or plinker wants to be able to shoot a greater number of rounds before he must swap magazines or reload an empty magazine (a tedious task), and the combat shooter has an imperative need to increase the number of rounds he can fire without reloading. The conventional linear cartridge magazine, however, has certain inherent limitations limiting the number of cartridges that can be stored and dependably fed to an automatic firearm. One such limitation is the sheer physical length of a straight or curved linear magazine intended to hold, say, thirty cartridges, particularly in the larger calibers such as 0.45 caliber. Another well-known limitation to simply lengthening existing straight magazines is the dependability of cartridge feeding. The cartridges must be urged toward the open end of the magazine by a spring-loaded follower which is compressed within the magazine; that spring must be strong enough to dependably feed all cartridges including the last one, yet the spring must not be so powerful as to prevent feeding the first few cartridges in a fully-loaded magazine. Furthermore, hand-loading cartridges into a straight magazine of thirty or more rounds capacity is tedious and time-consuming, and the increasing compression of the magazine spring makes it increasingly difficult to load the last few cartridges necessary to provide a fully-loaded magazine.

The prior art drum magazine, which is an alternative to the linear magazine, permits a number of cartridges to be stored in a generally cylindrical or spiral path, thereby overcoming one objection to the straight magazine. Drum magazines, however, are generally designed and constructed for use with a particular firearm which was, in turn, designed specifically to accommodate a drum magazine in place of a linear magazine. One example of such a prior-art drum magazine is found in U.S. Pat. No. 2,131,412 to Ostman. Such drum magazines of the art clearly cannot be used or readily adapted for use with pistols or other firearms designed to receive a linear magazine, since such drum magazines have no provision for feeding cartridges along the existing magazine-receiving receptacle of a pistol. One known attempt to provide a drum magazine for use with pistols resulted in the so-called "snail drum" magazine, having a magazine extension which tangentially joins the drum portion of a pistol. Cartridges are fed around the drum of the magazine and are then passed through the extension, exiting the drum on a path at a tangent to the circular or spiral cartridge storage path within the drum. The tangential construction of the snail drum places the drum's center of gravity off-center relative to a firearm fitted with the snail drum, however, thereby detracting from shooting accuracy. Efforts to overcome the off-center problem by bending or curving the magazine extension below the magazine well will cause problems in cartridge feeding, because the spring within the drum magazine has to force cartridges through the drum and then through a magazine extension including a friction-inducing curvature in the plane of cartridge travel.

SUMMARY OF THE INVENTION

Stated in general terms, the present invention is a cartridge magazine having a first path to receive a number of cartridges, having a second path communicating with the first path for feeding cartridges from that first path to the firearm, and having a cartridge follower arrangement including first follower apparatus which moves cartridges through the first path and a second follower apparatus which moves remaining cartridges through the second path when cartridges have been exhausted from the first path.

Stated in somewhat more specific terms, the present invention has a magazine drum for receiving cartridges, and a magazine extension joining the drum at an angle so that the drum and its extension are substantially symmetrical, thereby eliminating axial imbalance when the magazine extension is inserted within the existing magazine receptacle of a firearm. The magazine drum defines a channel for receiving cartridges, and a spring-biased first follower moves through that channel to urge cartridges forwardly toward the magazine extension. When the first follower reaches its maximum forward travel, with cartridges substantially emptied from the drum and remaining only in the magazine extension, a second follower leaves the drum and travels through the magazine extension behind the last remaining cartridge, thereby urging the remaining cartridges through the magazine extension. The second follower moves with the first follower through the cylindrical cartridge channel within the drum, and emerges from the first follower only after the first follower reaches maximum forward travel. Thus, the drum magazine of the present invention utilizes two separate but interrelated cartridge followers, the first follower moving cartridges through the curved-path cartridge channel within the drum, and the second follower moving remaining cartridges along the straight magazine extension.

Accordingly, it is an object of the present invention to provide an improved drum magazine.

It is another object of the present invention to provide a drum magazine that can be used with existing drum automatic pistols or submachine guns.

It is yet another object of the present invention to provide a drum magazine with improved cartridge feeding capability.

The foregoing and other objects and advantages will become more apparent from the following description of a preferred embodiment of the present invention.

DESCRIPTION OF PREFERRED EMBODIMENT

Figures 1, 2:
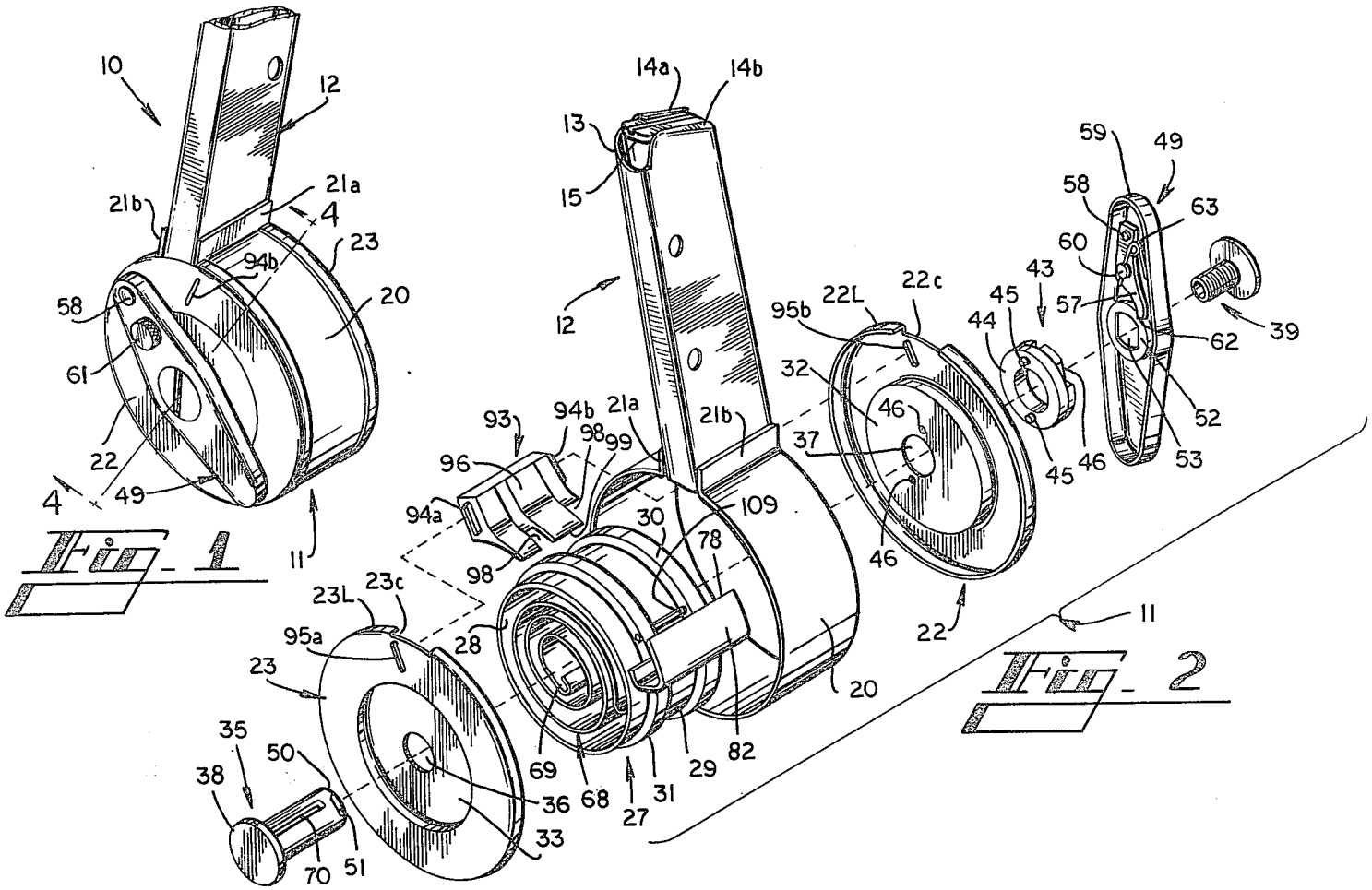
FIG. 1 is a pictorial view of the drum magazine according to a preferred embodiment of the present invention, as seen from the right-rear of the magazine and with the cartridge-feeding end of the magazine extension shown broken away for illustrative purposes.
FIG. 2 is an exploded view of the magazine shown in FIG. 1, viewed from the front along a line displaced 180° from that of FIG. 1 and with the magazine extension intact.

Turning initially to FIG. 1, the disclosed embodiment of the drum magazine is shown generally at 10. This drum magazine 10 includes a drum assembly 11, also shown exploded in FIG. 2, and a magazine extension 12 joined to the drum assembly. The magazine extension 12 is externally configured to fit within the magazine-receiving recess of a particular firearm, such as a conventional 0.45 Colt pistol by way of example, in place of the conventional magazine, and the upper end 13 of the magazine extension (FIG. 2) is configured to retain the uppermost cartridge in position to be chambered in the firearm by operation of the bolt assembly associated with the firearm. Referring specifically to FIG. 2, the upper end 13 of the magazine extension 12 is seen to have a pair of opposed spaced-apart inwardly turned lips 14*a* and 14*b* which retain the uppermost cartridge in place, and a magazine extension follower 15 shown in uppermost position beneath the lips. The magazine extension follower 15 is biased upwardly by a spring (not shown in FIG. 2) extending within the magazine extension 12, and explained below in greater detail.

Figure 4:
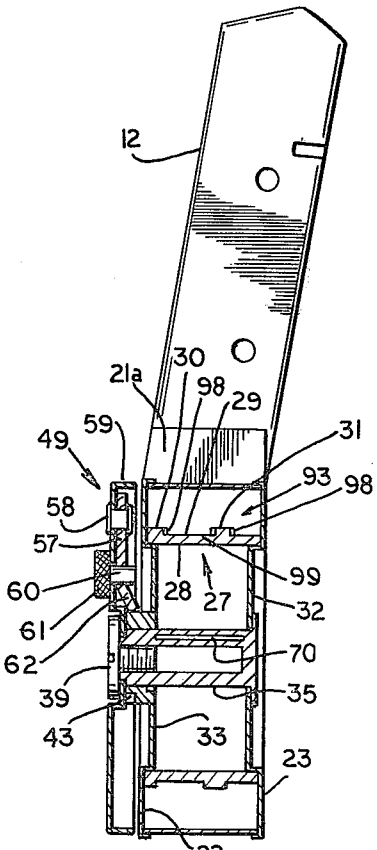
FIG. 4 is a partially broken-away view taken along line 4—4 of FIG. 1.

The drum magazine 10 includes a drum casing 20 in the shape of a hollow annular cylinder, as seen in FIG. 2, and the magazine extension 12 is secured to the top of the drum casing at a forwardly-angled rake as is most apparent in FIG. 4. The term "forward" as used herein refers to the side of the drum magazine 10 facing toward the front or muzzle end of the firearm, while the back of the drum magazine (seen in FIG. 1) faces toward the shooter. The forward rake of the magazine extension 12 relative to the drum casing 20 is necessary for proper feeding of the cartridges, as becomes apparent below. The magazine extension 12 is secured to the drum casing 20 by being welded to the two upturned flanges 21*a*, 21*b* extending upwardly from the drum casing 20 alongside the lower end of the magazine extension. The drum casing 20 is enclosed by the rear drum cover 22 and by the front drum cover 23, each of which removably fit in place over the respective sides of the drum casing. Each of the drum covers 22 and 23 has a lip 22L, 23L which fits over the respective edge of the drum casing, when the drum covers are in place enclosing the drum casing as shown in FIG. 1. Each of the drum covers also has a cutaway portion 22*c*, 23*c* at the tops thereof, as viewed in FIG. 2, to accommodate the magazine extension 12 when the drum covers are in assembly.

Figure 3:
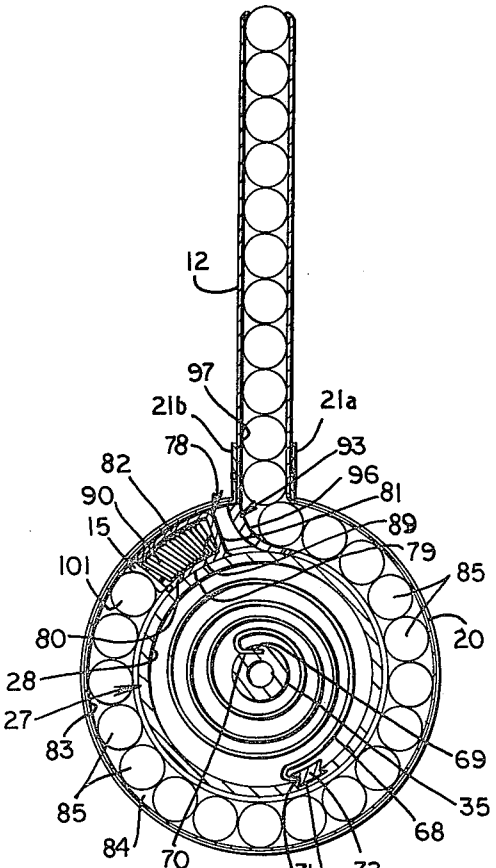
FIG. 3 is a front section view showing the disclosed magazine of FIG. 1 fully loaded.

The inner components of the drum assembly 11 are now described with particular reference to the exploded view in FIG. 2 and the section view of FIG. 3. Contained within the drum casing 20 is the rotor 27, in the shape of a hollow annular hub having an inner surface 28 and an outer surface 29 on which are formed a pair of outwardly-extending annular ridges 30 and 31. The rotor 27 is maintained in a central position within the drum casing 20 by the inwardly-dished portions 32 and 33 of the drum covers 22 and 23, respectively; those dished portions, as best shown in FIG. 4, extend axially a distance within the inner surface 28 of the rotor 27, and are radially dimensioned so that the rotor can freely rotate within the drum casing 20 relative to the fixed drum covers 22 and 23.

An axle 35 extends through aligned openings 36 and 37 in the centers of the drum covers 23 and 22, respectively. The axle 35 has a flanged head 38 which abuts against the exterior surface of the front drum cover 23 within the dished portion 33 thereof. As best seen in FIG. 4, the axle 35 extends through the hollow interior of the rotor 27 and through the opening 37 in the rear drum cover 22, where the axle is removably retained in place by the axle screw 39 which engages threads in the hollow interior of the axle.

A ratchet member 43 is disposed on the outside of the rear drum cover 22, in concentric relation to the axle 35 which freely extends through the hollow center of the ratchet member. The ratchet member 43 has a plane forward face 44 which lies flush against the outside of the dished portion 32, and a pair of pins 45 extend forwardly from the plane face and engage mating holes 46 in the dished portion of the rear drum cover, thereby effectively securing the ratchet member against rotation. The ratchet member 43 has a number of ratchet teeth 46 facing toward the rear, outwardly from the rear drum cover 22, as best seen in FIG. 6.

The winding handle 49 fits over the rear end 50 of the axle 35, behind the ratchet member 43 and concentrically aligned with the ratchet member. A pair of flat surfaces 51 are machined or otherwise formed on the exterior of the axle 35 at the rear end 50 thereof, and those flat surfaces engage mating flat sides 52 of the axle opening 53 formed in the winding handle 49. It will thus be understood that turning the winding handle 49 causes the axle 35 to turn relative to the drum assembly 11.

Figure 6:
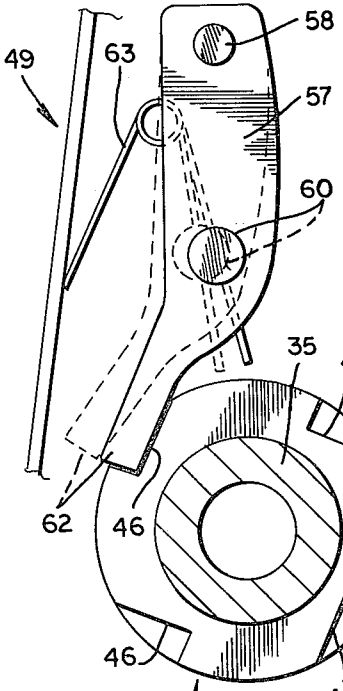
FIG. 6 is a detailed section view of the ratchet arrangement associated with the winding handle of the disclosed embodiment.

The winding handle 49 contains a ratchet assembly best shown in FIGS. 2 and 6 and including a ratchet catch 57 recessed within one end of the hollow winding handle. The ratchet catch 57 is an elongated member pivotably secured to the winding handle 49 by way of the pivot pin 58 located adjacent an outer end 59 of the winding handle. A ratchet catch pin 60 is secured to the ratchet catch 57 inwardly from the pivot pin 58, and the catch pin extends rearwardly through an opening in the winding handle to terminate in the knurled knob 61 (FIG. 4). The inner end of the ratchet catch 57 terminates at the catch surface 62, which cooperates with the teeth 46 of the ratchet member 43 when in assembly. A spring 63 normally biases the ratchet catch 57 to maintain engagement between the ratchet teeth 46 and the catch surface 62; the catch surface is momentarily moved out of engagement with the ratchet teeth whenever the ratchet catch is pivoted about the pivot pin 68 by moving the knob 61 sideways, relative to the elongated winding handle 49.

Turning now to the rotor 27 and its assembly within the drum casing 20, a rotor spring 68 is concentrically positioned between the inner surface 28 of the rotor and the axle 35. The rotor spring 68 may preferably be a flat coil spring of the type typically associated with wind-up clocks or the like. The inner end of the rotor spring 68 is bent inwardly and forwardly to provide a J-shaped hook 69, best seen in FIG. 3, which engages the longitudinal slot 70 formed along the length of the axle 35, perpendicular to a radius of that axle. The outer end 71 of the rotor spring 68 terminates in a spring catch 72, having a dovetail projection which slidingly mates with a dovetail slot 73 formed in the inner surface 28 of the rotor 27.

Mounted on the outer surface 29 of the rotor 27 is the magazine spring housing 78, having a foot 79 which is dovetailed to slidingly fit within a mating dovetailed slot 80 formed in the outer surface of the rotor. The magazine spring housing 78 has a back wall 81 extending outwardly from the foot 79, and has an outer wall 82 extending a distance forwardly of the back wall. The outer wall 82 of the magazine spring housing 78 clears the inner surface 83 of the drum casing 20. The annular space between the inner surface 83 of the drum casing and the outer surface 29 of the rotor 27 defines a channel 84 sufficiently wide to freely receive a number of cartridges 85, as shown in FIG. 3, and it should now be apparent that the magazine spring housing 78 is carried by the rotor 27 to move along a circular path within the cartridge channel 84. A roll pin 109 extends through the ridges 30 and 31 of the rotor 27, a short distance in front of the magazine spring housing 78, for a purpose described below.

Figure 5:
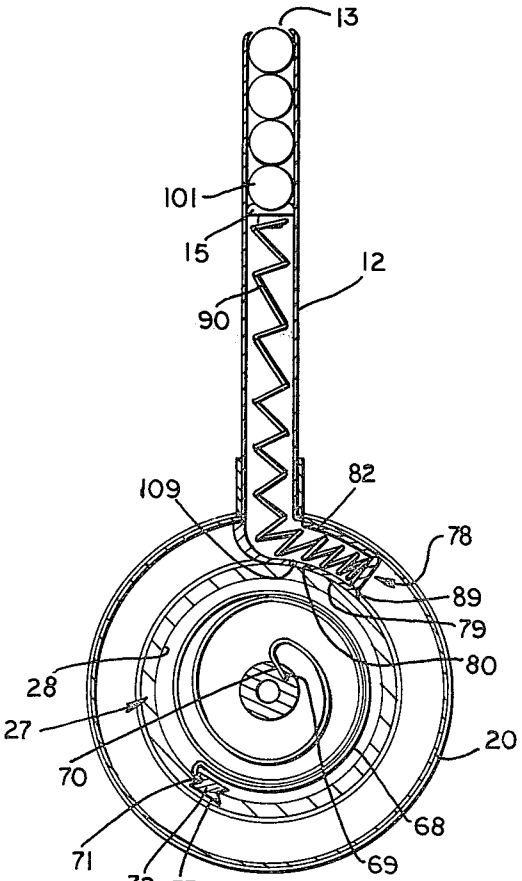
FIG. 5 is a section view of the present magazine similar to FIG. 3, except that only a few cartridges remain in the magazine extension.

The outer wall 82 of the magazine spring housing 78 defines a space 89 sufficient to receive the magazine spring 90 when that spring is fully compressed as shown in FIG. 3. The magazine spring 90 may be a conventional zig-zag flattened coil spring of the type conventionally used with linear magazines, as is more apparent from the expanded view of the spring shown in FIG. 5, with the inner end of the magazine spring abutting but not necessarily secured to the back wall 81 of the magazine spring housing, and with the outer or forward end of the magazine spring being secured to the magazine extension follower 15 which fits within the magazine spring housing and which can emerge from that housing to move along the magazine extension 12.

Turning now to FIGS. 2 and 4, a feed ramp 93 is located in the annular channel 84 at the junction of that channel with the interior of the magazine extension 12. The feed ramp 93 is held in position within the drum assembly 11 by means of the tabs **94*a* and 94*b* extending from the sides of the feed ramp and fitting within mating apertures 95*a* and 95*b* formed in the drum covers 23 and 22, respectively. The feed ramp 93 has a generally-radial arcuate curvilinear surface 96 which extends from the outer surface 29 of the rotor 27, to be substantially tangent with an inner surface 97 of the magazine extension 12. The inner edge of the arcuate surface 93 has slots 98 formed to provide clearance for the peripheral ridges 30 and 31 on the outer surface 29 of the rotor 27, so that the lower end 99 of the feed ramp fits between and radially inwardly of the ridges. The slots 98 extend upwardly along the ramp surface 96 to enhance cartridge movement along that surface. The feed ramp 93 is preferably configured to avoid contacting any surface of the movable rotor 27**, so as to avoid imparting any unwanted friction drag to the rotor in operation.

The operation of the drum magazine 10 will now be described. It is initially assumed that the drum magazine is fully loaded as shown in FIG. 3, with cartridges extending throughout the cartridge channel 84 in the drum assembly, and further extending up the magazine extension 12 all the way to the upper end 13 thereof. The rotor 27 is presently in its maximum-clockwise position as seen in FIG. 3, with the magazine spring 90 fully compressed within the magazine spring housing 78. With the magazine assembly 10 fully-assembled, the front and rear drum covers 22 and 23 being in place, the rotor spring 68 is tensioned by turning the winding handle 49 clockwise (as viewed from the rear of the drum magazine) several turns. The ratchet catch 57 will ratchet over the teeth 46 of the ratchet assembly at this time, to prevent the winding handle from returning.

It will now be understood that winding the rotor spring imparts counterclockwise rotating force to the rotor 27 as viewed in FIG. 3, thereby urging the cartridges 85 forwardly throughout the cartridge channel 84, around the arcuate surface 96 of the feed ramp 93 to turn the right-angle corner from the drum assembly 11 to the magazine extnesion 12, and up through the magazine extension. Although the magazine spring 82 is compressed at this time, the force of that spring is less than the rotational force imparted to the rotor by the rotor spring 68, so that the magazine spring remains compressed within the housing 78 as the rotor moves.

The magazine extension 12 is now ready to be fitted into a firearm. As each round is removed from the upper end 13 of the magazine extension, the rotor 27 indexes counterclockwise in response to the force of the rotor spring 68, thereby continuously urging the remaining cartridges 85 around the cartridge channel 84 and up the magazine extension 12. This counterclockwise movement of the rotor continues as firing proceeds, until the magazine spring housing 78 contacts the roll pin 109 to prevent further counterclockwise rotation of the rotor. As cartridges continue to be fed from the upper end 13 of the magazine extension, the compressed magazine spring 90 now emerges from the magazine spring housing 78 to urge forwardly the magazine extension follower 15, immediately behind the last remaining cartridge 101. It will be understood that the magazine extension follower 15 is configured to pass along the arcuate surfae 96 of the feed ramp 93, as cartridges are fed up the magazine extension 15, thereby to negotiate the approximately right-angle joinder between the magazine extension and the drum assembly 11. Cartridge feeding continues with firing of the firearm until the last remaining cartridge is fed from the magazine extension 12, at which time the follower 15 is in the fully-extended position shown in FIG. 2.

The drum magazine 10 is easily reloaded through the following procedure. Assuming the drum magazine has previously been fired until empty, the remaining tension of the rotor spring 68 is removed by pushing the knurled knob 61 to the left, as viewed in FIG. 1, thereby releasing the ratchet catch 60 from engagement with the ratchet member 43 and allowing the winding handle 49 to unwind by force of the rotor spring.

Cartridges are then inserted into the magazine extension 15 through the open upper end 13 until the entire magazine 10 is fully loaded, with successive cartridges progressively moving the magazine spring down the magazine extension and rotating the rotor back toward its initial position shown in FIG. 3. For example, a 30-round drum magazine as described herein can be manually loaded in the foregoing manner since the rotor spring need not be tensioned during loading. The winding handle 49 should then be turned clockwise until the first audible "click" of the ratchet is heard, to maintain minimum tension on the rotor through the rotor spring. Additional rotor spring tension necessary for feeding the cartridges during rapid-fire shooting may be applied by additional winding of the winding handle, before the magazine is fired.

It will thus be seen that the drum magazine 10 is substantially symmetrical and balanced on a vertical line passing through the center of the drum magazine, as viewed in FIG. 3, thereby avoiding any offset center of gravity which would adversely affect shooting accuracy. The rotor is allowed to turn within the drum with minimal resistance, while the depressed lower end of the feed ramp enables cartridges to make a 90° turn with little resistance. The magazine spring remains fully enclosed within the magazine spring housing when the drum is loaded and while the drum is rotating within the drum housing, thereby eliminating friction between the magazine spring and the inside wall of the drum housing. Moreover, the magazine spring is allowed to extend from its spring housing only after rotor movement terminates, so that the magazine spring need only move the remaining cartridges along a magazine extension the length of which need not be significantly greater than the length of conventional linear magazines.

Figure 7:
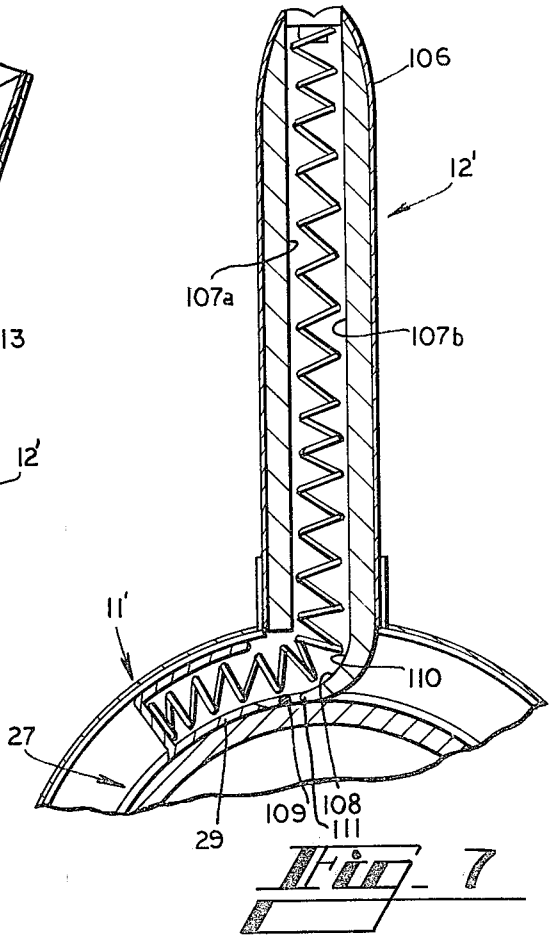
FIG. 7 is a partial rear section view of a drum magazine according to a modification of the disclosed embodiment.
Figure 8:
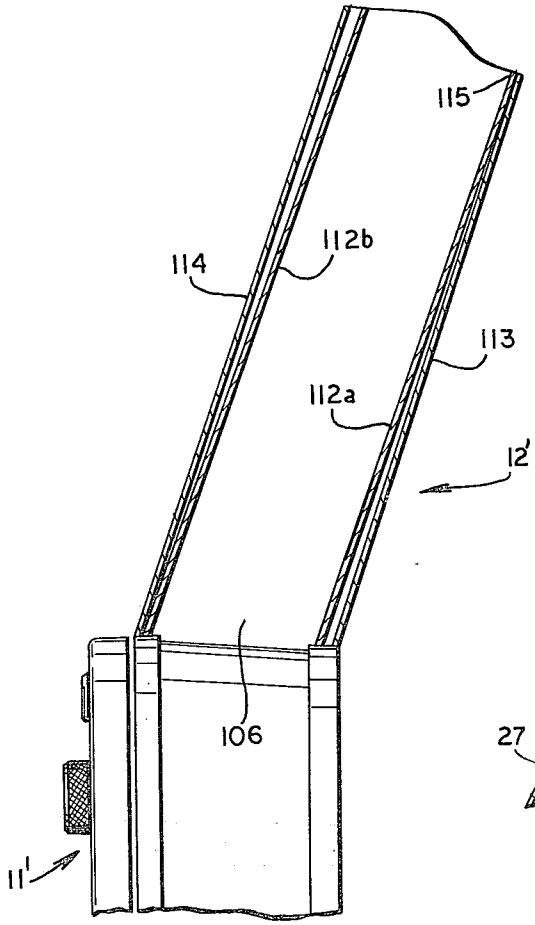
FIG. 8 is a partial left side sectioned view of the embodiment shown in FIG. 7, with the drum assembly not sectioned.

FIGS. 7 and 8 show a modification of the foregoing embodiment, intended for firearms that conventionally use a magazine containing cartridges in a staggered double-column arrangement. The drum magazine includes a drum assembly 11' and a magazine extension 12' extending therefrom on a line passing through the center of the drum assembly. The drum assembly 11' may be substantially identical to the drum assembly 11 described above, except for the cartridge feed ramp as discussed below. The magazine extension 12' is externally configured to fit within the magazine-receiving receptacle of a firearm that normally accommodates a magazine containing a staggered array of cartridges. One such firearm is the Browning 9 mm pistol. The interior of the magazine extension 12', however, defines a cartridge passageway 106 wide enough to permit feeding only a single column of cartridges, substantially like the single-column feed in the magazine extension 12 shown in FIGS. 3 and 5. The cartridge passageway 106 is defined within the magazine extension 12' by providing filler members 107*a* and 107*b* along the inner sides of the magazine extension 12', the filler members being sufficiently thick to reduce the external width of the magazine extension to the appropriate width of the cartridge passageway 106.

The lower end of the filler member 107*b* extends inwardly into the drum assembly 11', and provides the feed ramp 108 integral with that filler member. It should be understood that the feed ramp 108 has an arcuate curvilinear surface extending at its lowermost end 111 in conjunction with the outer surface 29 of the rotor 27, to an upper end 110 tangent to and forming an extension of the filler member vertical surface extending along one inner side of the magazine extension 12'. It should also be understood that the arcuate surface of the feed ramp 108 preferably has slots (not shown) comparable to slots 98 in the feed ramp of the previous embodiment, to provide clearance for the peripheral ridges on the outer surface 29 of the rotor 27. The construction shown in FIG. 7 thus permits the drum magazine to be used with firearms that normally accommodate a staggered-column magazine, while providing a feed ramp that is integral with the magazine extension.

Turning to FIG. 8, the magazine extension 12' is seen to have inserts 112*a* and 112*b* extending internally inwardly from the outside front wall 113 and outside rear wall 114, respectively, of the magazine extension. It can be seen that the insert 112*a* is substantially in contact with the front wall 113 of the magazine extension 12' at a point 115 toward the upper end of the magazine, and linearly tapers inwardly from the front wall as the magazine extension approaches the drum assembly 11'. Inversely, the rear insert 112*b* tapers outwardly from the lower end of the rear wall 114. The result of the inserts 112*a* and 112*b*, as seen in FIG. 8, is to provide a cartridge passageway 106 that is skewed in the cartridge-feeding plane so that the cartridges assume the proper feed angle for feeding into the receiver of the fire arm. That feed angle is determined for each type of fire arm, and is known to those skilled in the art. It should be understood, moreover, that the feed angle modifications provided by the inserts 112*a* and 112*b* may be required to simulate, within the passageway 106 of the magazine extension 12', the cartridge feed angle found in the staggered-feed magazines conventionally used with a particular type of firearm.

It will be understood that the foregoing refers only to a preferred disclosed embodiment of the present invention, and that numerous changes and modifications may be made therein without departing from the spirit and the scope of the invention as defined in the following claims.

I claim:

1. Drum magazine apparatus for supplying cartridges to a firearm, comprising:

means defining a cylindrical housing;

a rotor concentrically mounted within said housing to define an annular channel for receiving a plurality of cartridges;

extension means connected to said housing and defining a cartridge feeding channel in communication with said annular channel, said extension means being configured to fit within a magazine receptacle of a firearm so as to define a path of cartridge movement from said annular channel to the firearm;

guide means located adjacent the communication between said annular channel and said extension means to guide cartridges moving from said annular channel to said cartridge feeding channel;

a pair of covers disposed on respective ends of said cylindrical housing to enclose said housing;

said rotor having means defining an inwardly facing surface in proximate relation to said covers; and each of said covers including means operative to slidingly fit within said inwardly facing surface of said rotor so as to position said rotor in predetermined location within said cylindrical housing.

2. Drum magazine apparatus for supplying cartridges to a firearm, comprising:

means defining a cylindrical housing;

a rotor concentrically mounted within said housing to define an annular channel for receiving a plurality of cartridges;

extension means connected to said housing and defining a cartridge feeding channel in communication with said annular channel, said extension means being configured to fit within a magazine receptacle of a firearm so as to define a path of cartridge movement from said annular channel to the firearm;

guide means located adjacent the communication between said annular channel and said extension means, and operatively associated with said rotor to guide cartridges moving from said annular channel to said cartridge feeding channel;

a pair of covers operative to fit on respective ends of said cylindrical housing, so as to close said housing;

said rotor having means defining an inwardly facing surface in proximate relation to said covers; and each of said covers including means operative to slidingly fit within said inwardly facing surface of said rotor so as to position said rotor in predetermined location within said cylindrical housing.

3. Apparatus as in claim 2, further comprising:

spring means within said housing operative to rotate said rotor;

a winding member operable from outside said cylindrical housing and connected to said spring means to tension said spring means so as to urge said rotor in a certain direction;

ratchet means engaging said winding member to retain tension applied by said winding member to said spring means; and ratchet release means selectably operable from outside said cylindrical housing to disengage said ratchet means and release tension on said spring means, so as to facilitate loading cartridges in said drum magazine apparatus.

4. Apparatus as in claim 2, wherein:

said cartridge guid means engages means on said covers occupying a predetermined location when fitted on said housing, so that the cartridge guide means thereby is maintained by said covers in predetermined cartridge guiding relation to said cartridge feeding channel.

5. Apparatus as in claim 2, further comprising:

channel follower means disposed behind the cartridges received in said annular cartridge channel and operative to move through the cartridge channel so as to urge the cartridges through the cartridge channel toward said extension means;

means defining a follower housing associated with said channel follower means and movable through said cartridge channel with said follower means until said follower means reaches a predetermined extent of forward movement; and resilient means carried within said follower housing out of contact with any stationary surface of said channel during said movement through the cartridge receiving channel, and operative when said predetermined forward movement is reached to extend from said follower housing and urge said follower means and the remainder of the cartridges through said extension means toward the firearm.

6. Apparatus as in claim 5, wherein:

said resilient means within said follower housing is a first resilient means; and further comprising second resilient means operatively associated with said channel follower means to resiliently urge the channel follower means, including said follower housing and said first resilient means carried within, in a forward direction through said cartridge channel.

7. Apparatus as in claim 6, wherein:

said second resilient means urges the channel follower means for forward movement through the cartridge channel with a first amount of force; and said first resilient means urges forwardly the cartridge immediately in front of the channel follower means with a second amount of force less than said first amount of force, so that said first resilient means is held within said follower housing by the greater force of said second resilient means until the channel follower means and follower housing reach maximum forward movement in the channel.

8. Apparatus as in claim 7, wherein said first resilient means comprises a spring which remains compressed within said follower housing before maximum forward movement within the channel is attained, and which thereafter is resiliently extensible from said follower housing to urge said follower means and remaining cartridges through the extension means.

9. Apparatus as in claim 5, further comprising:

means operative to prevent said channel follower means from moving forwardly beyond the point of cartridge communication between said cartridge channel and said extension means, so that said resilient means carried within said follower housing can thereupon extend outwardly to urge the remaining cartridges through said extension means.

* * * * *